United States Patent [19]

Kashio

[11] 4,182,113

[45] Jan. 8, 1980

[54] ELECTRONIC TIME KEEPING DEVICE WITH TIME-SHARED TIMING INDICATOR

[75] Inventor: Toshio Kashio, Tokyo, Japan

[73] Assignee: Casio Computer Co., Ltd., Tokyo, Japan

[21] Appl. No.: 895,722

[22] Filed: Apr. 12, 1978

Related U.S. Application Data

[63] Continuation of Ser. No. 551,238, Feb. 20, 1975, abandoned, which is a continuation of Ser. No. 352,640, Apr. 19, 1973, abandoned.

[30] Foreign Application Priority Data

Apr. 21, 1972 [JP] Japan ..... 47-40085

[51] Int. Cl.[2] ..... G04B 19/24; G04C 3/00; G04B 19/30; G04B 27/00

[52] U.S. Cl. ..... 58/4 A; 58/23 R; 58/50 R; 58/58; 58/85.5

[58] Field of Search ..... 58/4 A, 23 R, 50 R, 58/58, 85.5

[56] References Cited

U.S. PATENT DOCUMENTS

| | | | |
|---|---|---|---|
| 3,733,810 | 5/1973 | Girard | 58/4 A |
| 3,810,356 | 5/1972 | Fujita | 58/23 R |
| 3,823,545 | 7/1974 | Vittoz et al. | 58/23 R |

*Primary Examiner*—Edith S. Jackmon
*Attorney, Agent, or Firm*—Flynn & Frishauf

[57] ABSTRACT

The device includes indicator elements capable of sequentially indicating the output of a counter in the forming of a plurality of time bands; an operation command signal distributor capable of generating an output for the performance of an operation having any given object corresponding to one selected from said indicator elements; and operating members for optionally selecting and causing the generation of command signals for the performance of an operation having any given object. The operation command signal distributor is enabled by an operating member when a specified indication element is lighted, to thereby command a selected operation having any given object, the command generation being a function of which indicator element is lighted.

18 Claims, 5 Drawing Figures

ELECTRONIC TIME KEEPING DEVICE WITH TIME-SHARED TIMING INDICATOR

This is a continuation, of application Ser. No. 551,238, filed Feb. 20, 1975, which is now abandoned which is a Continuation of Ser. No. 352,640, filed on Apr. 19, 1973 now abandoned.

This invention relates to an electronic time keeping device having a command selection device in which outputs for optional multi-purpose operation can be selectively controlled in accordance with indication operations of indicator elements which are arranged to be energized selectively in a plurality of time intervals.

A conventional indicator device such as a timepiece, operates to effect, in addition to usual hour-minute-second indication, multi-purpose functions such as indication of date,and week'day, and stopwatch operation. The dial plate of the device is a plurality of indicator sections operative for specific purposes, and hence requires push-buttons or like mechanisms for selective operation of the indicator sections. When, for example, a wristwatch, should be provided with such multi-functioning indicator sections, the external appearance of the watch tends to be damaged because of complexity of letters and numerals appearing on the dial plate and of additional push-button mechanisms required.

An object of the present invention is to provide an improved indicator device capable of simplifying not only the dial plate but also the operating mechanism and capable of performing multi-purpose operations.

SUMMARY OF THE INVENTION

This time keeping device of the present invention has indication elements indicating a plurality of time intervals arranged on the dial plate and an operation command signal distributor capable of optionally selecting by a manually operable member an output for the performance of any given multi-purpose operation corresponding to the operation state of a particular indication element. The invention has indicating sections to show a plurality of time intervals, such as a second indication element separately arranged in the time intervals so as to light every 10 seconds. An output for the performance of an operation having the desired purpose can be obtained by operating a manually operable member to enable the operation command signal distributor only when a given indication element is energized or enabled. Both indicating sections and operation sections can thus be structurally simplified.

BRIEF DESCRIPTION OF THE DRAWINGS

This invention can be more fully understood from the following detailed description when taken in connection with the accompanying drawing, in which.

DETAILED DESCRIPTION OF ILLUSTRATED EMBODIMENTS

Figure 1:
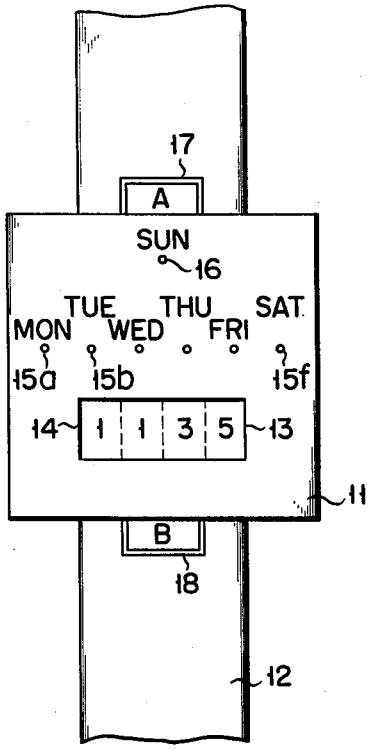
FIG. 1 is a front view showing a timepiece as an embodiment of this invention.

The timekeeping device of the invention effects digital indication of hour-minute-second, date of month, and day of week. Outputs used for multi-purpose function are intended generally to means outputs for correcting indication of hour, minute and second. In FIG. 1, a timepiece body 11 is mounted on a band 12 and has on its indication surface a time indicating section including a minute indicating section 13 and an hour indicating section 14 both represented by two digits, indicating elements for effecting sequential indication of seconds at a 10 second interval, and a separate indication element which emits light every second. Push buttons 17 and 18 are provided at both ends of the indication surface of body 11.

Figure 2:
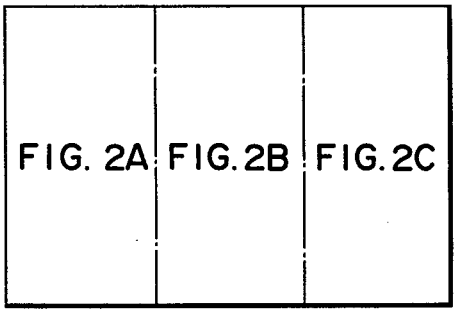
FIG. 2 is a composite showing of FIGS. 2A, 2B and 2C.
Figure 2A:
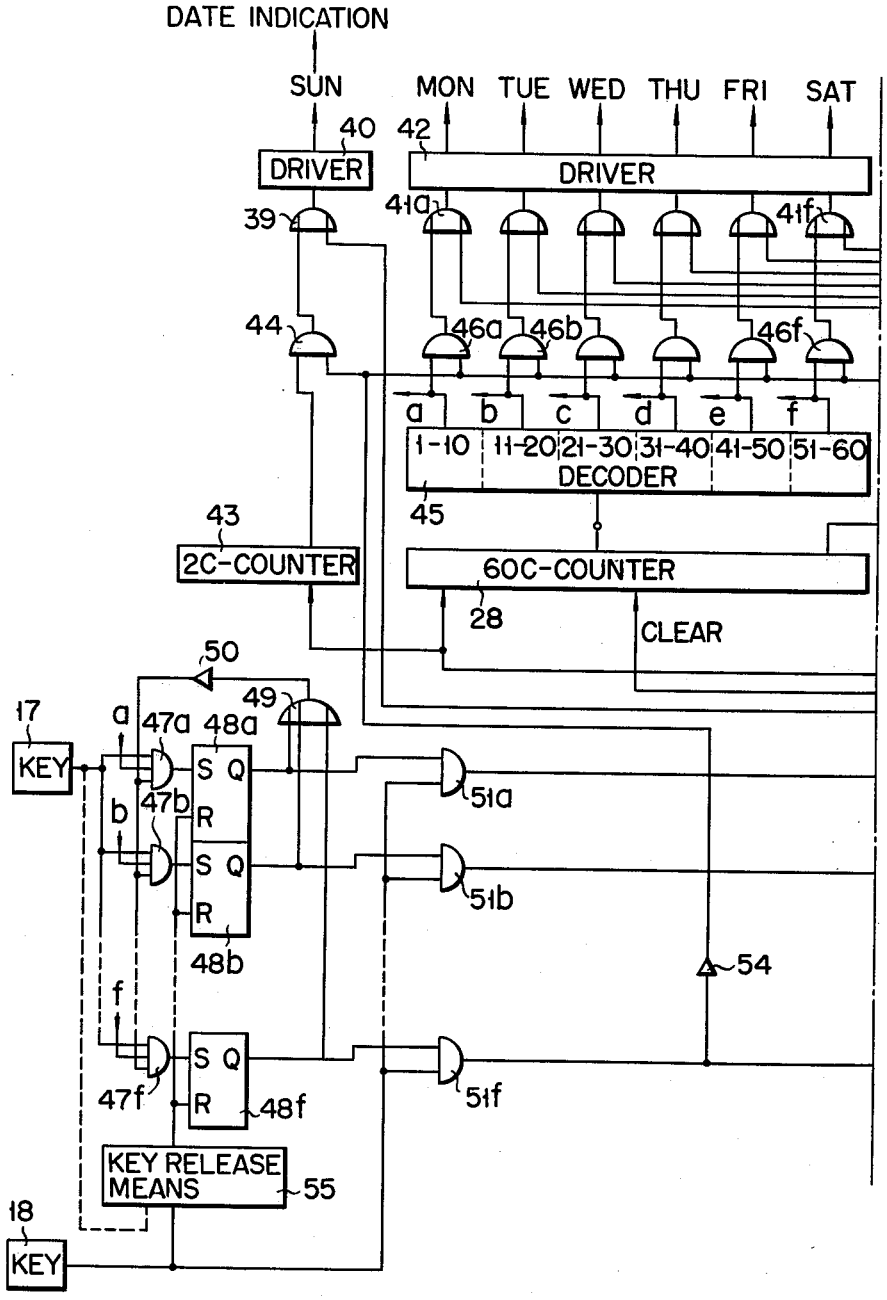
FIGS. 2A, 2B and 2C are block diagrams illustrating the timepiece of FIG. 1.
Figure 2B:
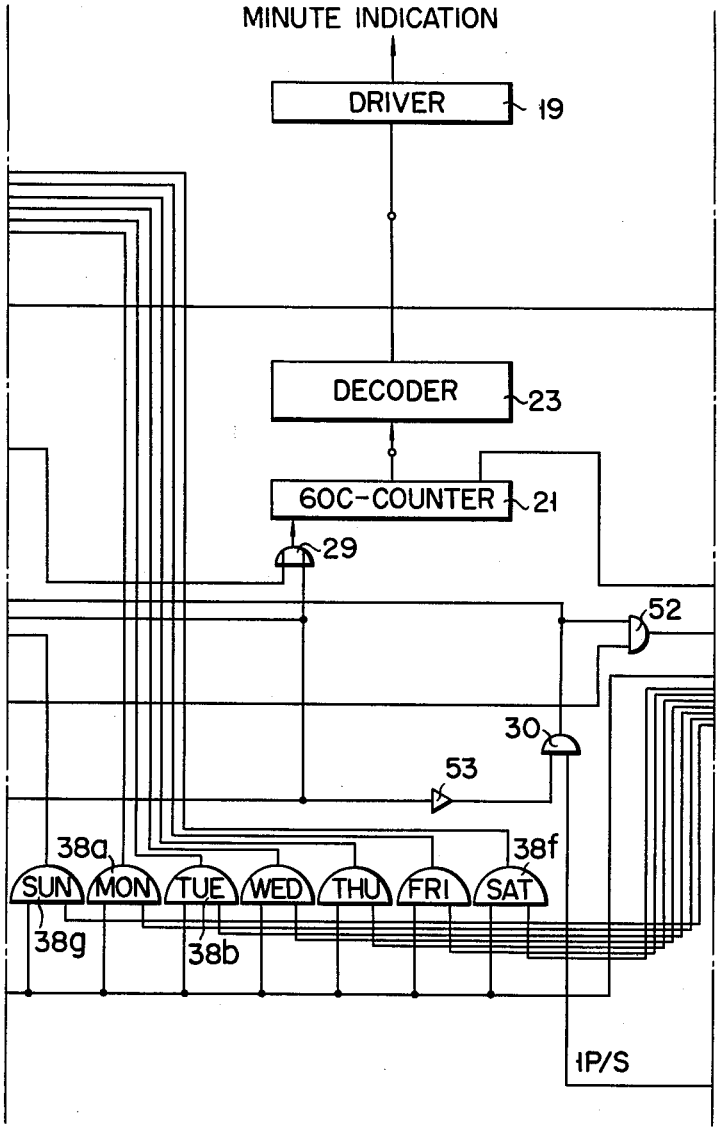
Figure 2C:
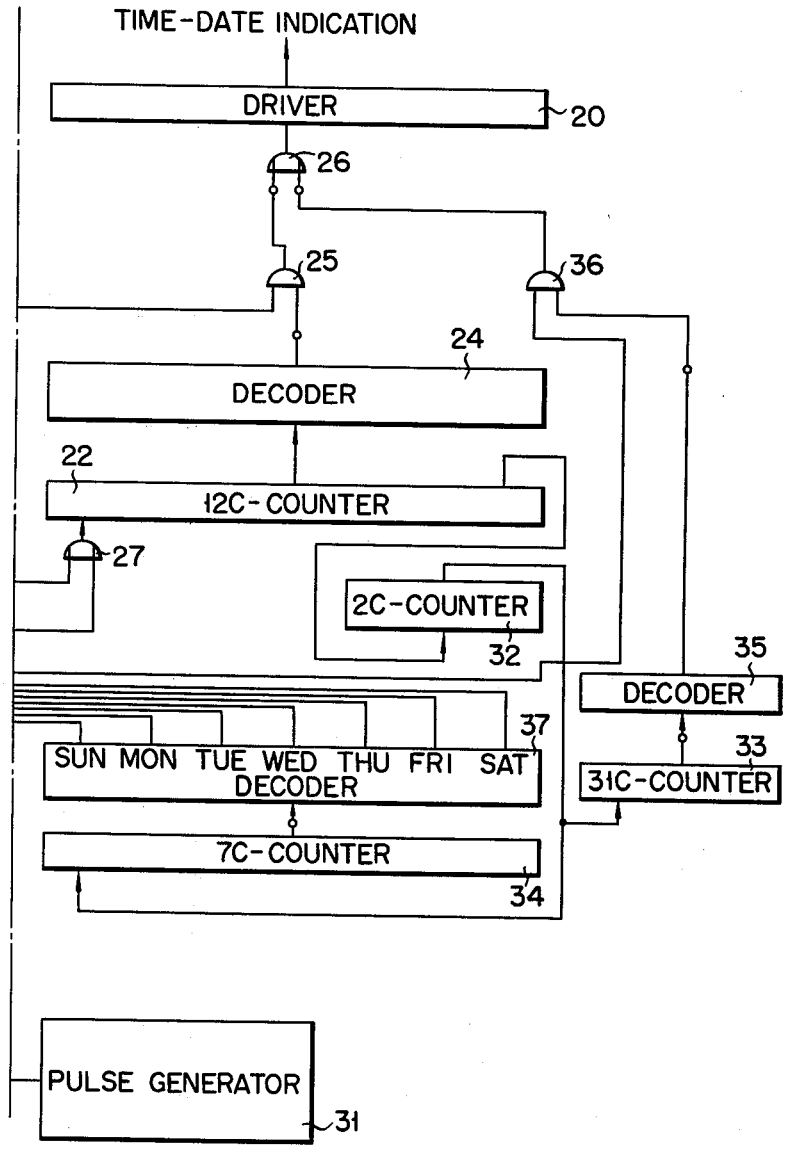

FIGS. 2A to 2C shown compositely in FIG. 2 are block diagrams illustrating a drive-control section of the timekeeping device shown in FIG. 1. Minute indication section 13 is operated by the output of a driver 19 driven by the count output of a 60-scale counter 21 through a decoder 23. Counter 21 is step advanced by a carry signal obtained at a 60-second interval from another 60-scale counter 28 through an OR circuit 29. The counter 28 is count driven by a pulse output generated from a pulse generator 31 through an AND circuit 30. In the hour indicating section, the hour is shown by the output of a decoder 24 through an OR circuit 26 and an AND circuit 25. AND circuit 25 has one of its gate inputs connected to the output of an inverter circuit 54 (described below). Decoder 24 has as its input a count output of a 12-scale counter 22 which is advanced when a carry signal from counter 21 is fed thereto through an OR circuit 27 every 60 minutes. Thereby, indication of data appears in the time indicating section. A required output can be obtained by feeding the output from counter 22 to a 31-scale counter 33 in the form a carry signal via a binary counter 32 every 24 hours and by supplying and driving the count output derived from counter 33 to driver 20 through a decoder 35, an AND circuit 36 and OR circuit 26 in the order mentioned.

Indication of day of week, in particular sequentially from Monday to Saturday, is effected by six indication sections or spots 15*a*, 15*b*, 15*c*, 15*d*, 15*e* and 15*f*, which are usually used also for indication by light every 10 seconds. The count output of counter 28 is formed by a decoder 45 into outputs generated once every 10 seconds. These outputs are fed via AND circuits 46*a* to 46*f* and corresponding OR circuits 41*a* to 41*f* to inputs of a driver 42 whose outputs are fed to indication spots 15*a* to 15*f* corresponding to Monday to Saturday indications shown in FIG. 1. Another gate input of each of AND circuits 46*a* to 46*f* obtains respective output from inverter 54 when an operating member to be described later is not operated.

A Sunday indication spot 16 can be energized to usually display indication every one second by actuating a driver 40 by the output from an OR circuit 39. One of the inputs of OR circuit 39 is connected to an AND circuit 44 having one of its gate inputs connected to the output of inverter 54 and having the other of its inputs connected via AND circuit 30 to the output of pulse generator 31. In the timepiece digitally showing date, hour, minute, week's day as described above, count outputs from 60C-counter 28 divided into time intervals in the driver 45 every 10 seconds are optionally selected. The operation selecting circuits and operating members to obtain outputs for the performance of operations having many different purposes corresponding to these outputs will now be described in detail.

The operation selecting circuits (alternately termed "operation command signal distributor") have AND circuits 47*a* to 47*f* having a plurality of output terminals (a to f in this embodiment) divided into 10 second time intervals by the decoder 45 and flip-flops 48*a* to 48*f* operating the outputs of the AND circuits as set inputs.

Any additional operations are performed by the outputs of flip-flops 48*a* to 48*f*. The other gate input terminal of each of AND circuits 47*a* to 47*f* is connected to operating member 17. Still another gate input terminal of each of AND circuits 47*a* to 47*f* is coupled to a respective output terminal of flip-flops 48*a* to 48*f* through a common OR circuit 49 and an inverter circuit 50. The reset terminal of each of flip-flops 48*a* to 48*f* is connected to an operating member 18 through a key release means 55. AND circuits 51*a* to 51*f* each have gate inputs connected respectively to the output of the operator 18 and to each of the outputs of flip-flops 48*a* to 48*f*. The outputs from these AND circuits 51*a* to 51*f* are used to perform varying multiple functions. In the illustrated example, such varying multiple functions comprise an hour correction output from AND circuit 51*a*, minute-second correction output from AND circuit 51*b*, and date-week day correction output from AND circuit 51*f*.

The hour correction output of AND circuit 51*a* is supplied to an input of counter 22 via an AND circuit 52 and the OR circuit 27. To the other of the gate inputs of AND circuit 52 is supplied a pulse signal from pulse generator 31 through AND circuit 30.

The minute-second correction output is supplied as one of the gate inputs of AND circuit 30 through an inverter circuit 53. This output is also applied as a clear operation signal with respect to the counter 28 and one of the gate inputs of the OR circuit 29 which becomes an input to the counter 21. The output terminals for day and day of week indication are connected to one of the gate input terminals of the AND terminal 44 through the inverter circuit 54 and also to the gate input terminals of other AND circuits 46*a* to 46*f* respectively. One of these outputs becomes one gate input to each of the AND circuits 38*a* to 38*f* corresponding to one of weekdays beginning with Monday, and to the AND circuits 38*g* corresponding to Sunday. The count output of the counter 33 for date indication becomes one gate input of the AND circuit 36 through the decoder 35. An output from the 12-scale counter 22 becomes a carry signal through a 2-scale counter 32 every 24 hours. A 7-scale counter 34 receives this carry signal. The resultant output makes an output corresponding one chosen among a period of seven days beginning with Sunday in the decoder 37. The output of the decoder 37 becomes one gate input to each of the AND circuits 38*a* to 38*g*.

The operation of the indication device of the invention, including the operation selecting circuit so constructed, will now be described in detail.

When hours, minutes and seconds are normally shown on the dial plate of the timepiece, neither a first operating member 17 nor a second operating member 18 is operating No output is, therefore, obtained from the operation selecting circuit. Outputs are, however, derived from an inverter 53 and the pulse generator 31. The AND circuit 30 is thus open to count-operate the counter 28. As a result, a carry signal is delivered to the counter 21 through the OR circuit 29 and count-operated so as to enable it to show minutes in the minute indicating section 13 of FIG. 1 through the decoder 23 and driver 19. A carry signal is derived from the counter 21 every 60 minutes and fed to the counter 22 through the OR circuit 27 to cause count operation. Hours are shown in the hour indicating section 14 through the decoder 24, AND circuit 25, OR circuit 26 and driver 20. The AND circuit 25 obtains an output from the inverter 54 to open the gate since the operating member 18 is nonoperating. Weekdays are indicated in the weekday indicating sections 15*a* to 15*f* corresponding to a period of seven days beginning with Monday. Count outputs from the counter 28 are formed into time intervals in the decoder 45 every 10 seconds. A driver 42 is driven by these outputs through the AND circuits 46*a* to 46*f* and OR circuits 41*a* to 41*f*. Lighting display of the day can thus be made every 10 seconds.

Sunday indication is given in the Sunday indicating section 16. The AND circuit 44 will be open with an output from the inverter 54 and an output obtained by transmitting a pulse signal from the pulse generator 31 through the AND circuit 30 and 2-scale counter 43 as gate inputs. The lighting display can be effected every two seconds through the AND circuit 44, OR circuit 39 and driver 40.

When an hour correction is made normally, the following operations must be performed. Assume that an hour correction is made only when a specified weekday (for example, Monday) indicating section 15*a* is lighted. When this particular indicating section 15*a* is lighted, the operator operates a first operating member 17 to energize the gate input of the AND circuit 47*a* and to give its output to a flip-flop circuit 48*a*. The output of the circuit 48*a* is also fed to the OR circuit 49, closing the other AND circuits 47*b* to 47*f* through an inverter 50. Only the output for hour correction is supplied to the gate of the AND circuit 51*a*, thus being ready for the hour correction operation. If a second operating member 18 is operated in such a state, the AND circuit 51*a* will be open and the AND circuit 52 will be conducting, resulting in the displacement of the 12-scale counter 22 for hour correction, occurring every one second. The count output of the counter 22 will drive the driver 20 through the decoder 24, AND circuit 25 and OR circuit 26, regardless of whether a carry signal is present or not. If the operator confirms correction on the hour indication and releases the operating condition of the operating member 18, the AND circuit 51*a* will be closed, stopping the hour indication operation and completing the hour correction operation.

The minute-second correction will now be described in detail. Assume now that a minute-second correction is given only when a particular weekday (for example, Tuesday) indicating section 15*b* is lighted. Upon lighting of the Tuesday indicating section 15*b*, the operator will operate the operating member 17. In this case, the AND circuit 47*b* will generate an output to actuate the flip-flop circuit 48*b* and produce an output therefrom. If the operating member 18 is operated under these conditions, the AND circuit 51*b* will be open to displace the 60-scale counter 21 for minute indication through the OR circuit 29. In this case, the output from the AND circuit 51*b* will close the AND circuit 30 through the inverter 53 and cease to supply the count input to the 60-scale counter 23 for the aforesaid second indication. At the said time, the 60-scale counter 28 otherwise in a count state will be cleared upon receiving a clear signal and discontinue the transmission of the carry signal. In the 60-scale counter 21, therefore, only one digit is added to the next high digit position only by an output for minute-second indication. Now in a waiting state, if the operator confirms completion of the minute indication correction and releases the operating condition of the operating member 18, the AND circuit 30 will be open again and the 6-scale counter 26 will resume its operation. The 60-scale counter 21 for minute indication will perform count-operation by a carry signal from the counter 28, resulting in advance of the minute indicator with respect to the corrected minute indicating time.

Date and weekday indications made in the indicating sections 14 and 15*a* to 15*f* respectively will now be described. Assume that an output for weekday indication is obtained only when a specified (for example, Saturday) indicating section 15*f* is lighted. Upon lighting this particular section, the operator will operate the operating member 17, release the gate of the AND circuit 47*f* and take an output from the flip-flop circuit 48*f*. Upon operating the operating member 18, the AND circuit 51*f* will be released and the output will no longer by produced from the inverter 54. The generation of all outputs for second indication through the AND circuits 44 and 46*a* to 46*f* will be stopped. On the other hand, the output from the 7-scale counter 34 will release the AND circuits 38*a* to 38*f* and 38*g* for weekday and Sunday indicating through the decoder 37. The outputs from the drivers 40 and 42 can be obtained by deriving outputs from OR circuits 39 and 41*a* to 41*f*. A weekday indication is given by selecting from the AND circuits 38*a* to 38*g* AND circuits corresponding to this particular weekday. In this case, a carry signal from the 12-scale counter 22 drives the 31-scale counter 33 through the 2-scale counter 32. An output for date indication can be obtained by the driver 20, repeating this process through the decoder 35, AND circuit 36, and OR circuit 26 in turn.

As described above, an output for multi-purpose operation can be obtained by selecting a specified one from a plurality of time intervals by means of an operating member 17 to operate the AND circuits and flip-flops constituting the operation selecting circuit and derive an output for multi-purpose operation. At the same time, the outputs from the selected flip-flops are transmitted through the OR circuit 49 to stop the generation of output of the inverter 50. The gates of AND circuits other than the selected AND circuits and flip-flop circuits can thus be closed, thereby preventing all the other outputs from being actuated simultaneously. When the operating member 18 is released, an operation selecting output is no longer be generated and a reset signal is supplied to the selected flip-flop circuit by a keying means 55.

The foregoing description refers to the second operating member 18 mounted in addition to the first push button 17 to choose one among many operations. It is, however, possible to perform an operation having any other purpose by connecting directly between the operating member 17 and keying means 55 shown dotted and mounting a single operating member 17 on the timepiece body, even without the AND circuits 51*a* to 51*f* and the operating member 18.

Among the multi-purpose operations, there are alarm display operation, stopwatch display operation, etc.

The foregoing description refers to the seven display sections corresponding to a week (a period of seven days beginning with Sunday) for the selection of an operation having any given purpose. However, these display elements need not be arranged in this order.

What is claimed is:

1. A multi-function electric timekeeping device for carrying out normal timekeeping as well as at least one additional functional operation other than normal timekeeping and time setting, comprising:

a pulse generator (31) for generating standard clock pulses;

counter means (43, 28, 21, 22, 32) coupled to said pulse generator for counting said standard clock pulses to provide outputs corresponding to different timings and to form a plurality of successive cycles each of a specific counted value;

a time indicating means (15*a*–15*f*, 16, 13, 14) having sections (13, 14, 16) for visually displaying at least hours and minutes, and a plurality of further sections (15*a*–15*f*) for cyclically and visually displaying different timings corresponding to the outputs of said counter means, the timings displayed by said further sections corresponding to times when different functional operations, comprising said at least one functional operation other than normal timekeeping, of the multi-function electric timekeeping device may be initiated;

decoding means (45, 23, 24) coupling said counter means to said time indicating means and selectively causing said time indicating means to display the contents of said counter means;

a manually operable member (17) to be operated by the user in accordance with the condition of the visual display at said plurality of further sections (15*a*–15*f*); and an operation command signal distributing circuit (47, 48, 49, 50) coupled to receive inputs from said manually operable member (17), said operation command signal distributing circuit including a decoder coupled to said counter means for selectively generating one of a plurality of different function command signals responsive to the counting condition of said counter means and to the condition of said further display sections upon actuation of said manually operable member for distributing to said counter means a command signal which is a unique function of the outputs of the counted value for displaying timings from said counter means when said manually operable member is operated, said command signals being different from the inputs received by said decoder of said disbributing circuit from said counter means, and at least one of said command signals designating a function other than a timekeeping and a time-setting function, said distributed command signal initiating a desired one of said additional functional operations of the multi-function timepiece in accordance with the timings displayed by said plurality of further sections (15*a*–15*f*) of said time indicating means so that a respective functional operation is initiated in response to each distributed signal.

2. A time keeping device according to claim 1 wherein said further sections (15*a*–15*f*) of said time indicating means comprises a plurality of indicating sections spaced one from another.

3. A time keeping device according to claim 1 or 2 wherein said sections for displaying different timings comprises six indicating sections for displaying a time period of less than one minute by ten second intervals.

4. A time keeping device according to claim 1 wherein said operation command signal distributing circuit includes a plurality of AND circuits (47*a*–47*f*) each coupled to receive command signals from said manually operable member and signals corresponding to outputs of the counted value for displaying timings from said counter means (28); a plurality of flip-flop circuits (48*a*–48*f*) each connected to respective ones of said AND circuits; and a control circuit including an OR circuit (49) connected to each output terminal of the respective flip-flop circuits and an inverter (50) disposed between the output terminal of said OR circuit and an input terminal of each of said AND circuits, an output of any one of said flip-flop circuits providing an input to said AND circuits through said inverter (50).

5. A time keeping device according to claim 1 wherein said sections (13, 14, 16) for visually displaying hours, minutes and seconds are each controlled for time correction by a respective one of said distributed command signals generated by said distributing circuit upon operation of said manually operable member, thereby correcting the time displayed by said time keeping device.

6. A time keeping device according to claim 1 wherein said decoder of said operation command signal distributing circuit comprises a logic circuit coupled to receive command signals from said manually operable member and signals corresponding to the outputs of the counted value for displaying timings from said counter means (28) for logically combining said signals to produce different function signals responsive to respective conditions of said counter means when said manually operable member is operated.

7. A time keeping device according to claim 1 wherein said operation command signal distributing circuit includes a plurality of gate circuit means (47*a*–47*f*) each coupled to receive command signals from said manually operable member and signals corresponding to the outputs of the counted value for displaying timings from said counter means (28), said gate circuit means being selectively operable by said manually operable member in accordance with the timings displayed by said plurality of further sections, said gate circuit means generating a respective command signal corresponding to the gate circuit means operated by said manually operable member.

8. A time keeping device according to claim 7 wherein said manually operable member selectively operates at least one, but not all of said gate circuit means when it is actuated.

9. A multi-function electric time keeping device comprising:

a pulse generator (31) for generating standard clock pulses;

counter means (43, 28, 21, 22, 32, 34, 33) coupled to said pulse generator for counting said standard clock pulses and to form a plurality of successive cycles each of a specific counted value and providing outputs corresponding to different timings;

a time indicating means (15*a*–15*f*, 16, 13, 14) having indicating sections (13, 14, 16) for visually displaying hours, minutes and seconds, at least one of said sections further selectively displaying items of day, and days of a week responsive to a selective switching operation, and having a plurality of further sections (15*a*, 15*b*, 15*c*, 15*d*, 15*e*, 15*f*) for cyclically and visually displaying different timings corresponding to the outputs of said counter means, the timings displayed by said further sections corresponding to times when the different functional operations of the multifunction electric time keeping device may be initiated;

decoding means (45, 23, 24, 35, 37) coupling said counter means to said timing indicating means and selectively causing said time indicating means to display the contents of said counter means;

a manually operable member (17) to be operated by the user in accordance with the condition of the visual display at said plurality of further sections (15*a*–15*f*);

an operation command signal distributing circuit (47, 48, 49, 50) coupled to receive inputs from said manually operable member (17) for distributing to at least one of the input sides of said counter means (43, 28, 21, 22, 32) and output sides of said counter means (43, 28, 21, 22, 32, 34, 33) a command signal from said manually operable member which corresponds to the counted value of said counter means when said manually operable member is operated, the distributed signal initiating a desired functional operation of the multi-function timepiece in accordance with the timings displayed by said plurality of further sections; and switching means (25, 46) coupled to said distributing circuit for receiving any of the outputs therefrom and for generating a switching control signal to control the output of said decoding means when said manually operable member is operated in accordance with one of the timings displayed by said plurality of further sections for switching a display content of said indicating sections (13, 14, 16) displaying the hour, minute and second into a display content of days of a week and days.

10. A time keeping device according to claim 9 wherein said operation command signal distributing circuit includes a plurality of AND circuits (47*a*–47*f*) each coupled to receive command signals from said operable member and signals corresponding to outputs of the counted value for displaying timings from said counter means (28); a plurality of flip-flop circuits (48*a*–48*f*) each connected to respective ones of said AND circuits; and a control circuit including an OR circuit (41) connected to each outut terminal of the respective flip-flop circuits and an inverter (50) disposed between the output terminal of said OR circuit and an input terminal of each of said AND circuits, an output of any one of said flip-flop circuits providing an input to said AND circuits through said inverter (50).

11. A time keeping device according to claim 9 wherein said switching means comprises a logic circuit (25, 46*a*–46*f*) coupled to receive as a switching command output any specified one of the otputs from said distributing circuit to block outputs corresponding to said second, minute and hour from said decoder, and for causing the output from said decoder for designating days of a week to be supplied to said indicating section for indicating seconds and for further causing the output from said decoder for designating the day to be supplied to said indicating section for indicating the hour.

12. A time keeping device according to claim 9 wherein said sections (15*a*–15*f*) of said time indicating means comprises a plurality of indicating sections spaced one from another.

13. A time keeping device according to claim 9 wherein said sections for displaying different timings comprises six indicating sections for displaying a time period of less than one minute by ten second intervals.

14. A time keeping device according to claim 9, wherein said sections (13, 14, 16) for visually displaying hours, minutes and seconds are each controlled for time correction by a respective one of said distributed command signals generated by said distributing circuit upon operation of said manually operable member, thereby correcting the time displayed by said time keeping device.

15. A time keeping device according to claim 9 wherein said operation command signal distributing circuit comprises a logic circuit coupled to receive command signals from said manually operable member and signals corresponding to the outputs of the counted value for displaying timings from said counter means (28) for logically combining said signals to produce different function signals responsive to respective conditions of said counter means when said manually operable member is operated.

16. A time keeping device according to claim 9 wherein said operation command signal distributing circuit includes a plurality of gate circuit means (47*a*–47*f*) each coupled to receive command signals from said manually operable member and signals corresponding to the outputs of the counted value for displaying timings from said counter means (28), said gate circuit means being selectively operable by said manually operable member in accordance with the timings displayed by said plurality of further sections, said gate circuit means generating a respective command signal corresponding to the gate circuit means operated by said manually operable member.

17. A time keeping device according to claim 16 wherein said manually operable member selectively operates at least one, but not all of said gate circuit means when it is actuated.

18. A timekeeping device according to claim 1 or 2 wherein said decoder of said operation command signal distributing circuit produces only one command pulse for each operation of said manually operable member, each command pulse representing only one kind of function instruction signal.

* * * * *